United States Patent [19]

Lacey

[11] Patent Number: 4,865,069

[45] Date of Patent: Sep. 12, 1989

[54] FLUID DRAIN PUMP

[76] Inventor: Sylvester Lacey, #9 Kifer Hill Rd., Penn, Pa. 15675

[21] Appl. No.: 31,584

[22] Filed: Mar. 30, 1987

[51] Int. Cl.[4] ..... F04F 10/00

[52] U.S. Cl. ..... 137/132; 52/169.5; 137/362; 137/363; 210/170; 405/36

[58] Field of Search ..... 52/169.5; 137/132, 362, 137/363; 210/170, 532.2, 747; 405/36, 39, 40, 41

[56] References Cited

U.S. PATENT DOCUMENTS

| | | | |
|---|---|---|---|
| 374,726 | 12/1887 | Ayer | 137/135 |
| 629,277 | 7/1899 | Slack . | |
| 903,395 | 11/1908 | Miller | 137/132 |
| 1,120,351 | 12/1914 | Weston | 210/532.2 X |
| 1,442,314 | 1/1923 | Weir | 137/147 X |
| 1,582,914 | 5/1926 | Farley | 210/532.2 X |
| 1,734,777 | 11/1929 | Pike | 52/169.5 |
| 2,118,532 | 5/1938 | Widmann | 137/140 X |
| 2,795,542 | 6/1957 | Horne et al. | 405/36 X |
| 4,227,266 | 10/1980 | Russell | 52/169.5 X |
| 4,260,283 | 4/1981 | Croy . | |
| 4,479,482 | 10/1984 | Cherington | 137/132 X |
| 4,682,579 | 7/1987 | Bigham | 137/132 X |
| 4,717,284 | 1/1988 | Gress | 137/142 X |

*Primary Examiner*—Gerald A. Michalsky
*Attorney, Agent, or Firm*—Jon M. Lewis

[57] ABSTRACT

A self actuating storm or flood pump used with septic tank sewage treatment facilities with leach beds and also used to pump excessive fluids from the lower floors of buildings such as flooded basements in dwellings. A tubular means extends in a vertical direction in said leach bed or from said floor and means are provided for fluid such as surronding water to seek its own level inside of the tubular means. A siphon hose having opposing ends extends from a lower portion of said tubular means up toward the upper portion of the tubular means and then outward from the tubular means to a disposal area. The outward end of the siphon hose terminates at a lower vertical point than the inner end of the siphon house. The inner end of the siphon hose communicates with the inside diameter of the tubular means so that excess fluid levels cause the fluid to flow through the siphon hose to the disposal area until the fluid level surrounding said tubular means reaches a level just below the inner end of the siphon hose. A removable top of the tubular means allows chlorine in solid or liquid form to be added to purify any water that is discharged.

11 Claims, 3 Drawing Sheets

FLUID DRAIN PUMP

FIELD OF INVENTION

The present invention has to do with a storm actuated siphon pump for water treatment facilities and more specifically is for sewage treatment systems such as septic tank systems utilizing leach beds. The siphon pump may be installed in a leach bed area and excessive fluid filling of the leach bed area activates the siphon so that the leach bed is drained of a sufficient amount to allow it to operate efficiently. The siphon pump according to the present invention may also be used for draining basements or lower floors of buildings of ground water or flood water and may be used as a back-up system when conventional drains clog in such basement systems.

BACKGROUND OF THE INVENTION

Septic systems are well known for individual home use where municipal or other more centralized and collective systems are not available. In such systems, the waste fluid or water is discharged from the home to a septic tank soil absorption system. Such a system usually comprises a large watertight tank made of appropriate material and fed by the house drain. On the far side of the tank from the house, a pipe leads out from the tank to a leach bed or soil absorption area. When the fluid waste from the house enters the septic tank, a bacterial action breaks the solid waste matter down into sludge, liquid, scum, and gases. The sludge settles to the bottom of the tank, the scum forms on top of the fluid level in the tank, the gases pass back up the tanks inlet, and the new fluid joins the other fluid part of the waste from the house to form an effluent which flows out of the tank to the absorption field.

The absorption field usually comprises a ground cover with the fluid effluent being distributed 1 to 3 feet beneath the top of the ground cover. The soil where the effluent is delivered should have a good percolation rate so that the water or fluid may be evaporated up through the ground cover or be filtered down through the soil to rejoin the water table in the area. Usually it is highly desirable that all surface waters, downspouts, and footer drains not be directed to the septic system as too much water will not allow the natural percolation rate of the soil to do its job efficiently. In a properly designed system, most surface waters are diverted from entering the septic system; however, there is usually no way to handle the excess fluid that enters the septic system as the result of a heavy storm. Storm water is usually just accepted as unavoidable and no special designs are employed to handle such excess fluid other than normal drainage that has already been designed in the system. Rain water also brings with it silt or helps create silt in the leach bed that can reduce or clog the necessary percolation function of the leach bed soil. It is desirable that silt not enter the system and that any that is present be removed before it can adversely affect the performance of the leach bed.

In addition, lower floors in buildings such as the basements of dwellings have no automatic back-up system to drain flood waters or excessive fluid that can be caused by storms or drain clogging. When such flooding occurs, conventional pumping systems are normally employed to remove the flood or excess water from the basement.

SUMMARY OF INVENTION

According to the present invention a self-actuating siphon pump is designed for installation in septic tank soil absorption systems or in lower floors of buildings such as basements of dwellings. The self-activating pump comprises a vertically extending tubular pipe with a siphon hose extending through an upper section of the pipe. One end of the siphon tube extends toward the bottom and preferably the inside of the vertical tubular pipe and the other end of the siphon tube extends outwardly and downwardly from near the top and outside diameter of the vertical tube. The end of the siphon hose on the outside of the vertical tube must be able to extend to a lower vertical position than the lowermost end of the siphon hose that may be located on the inside of the vertical tube. The vertical tubular section also is to be provided with means to allow the surrounding outside fluid or water to seek its own level inside the vertical tubular section and also communicate with the end of the siphon hose nearest or inside the vertical tube. Such means usually will be provided by the bottom end of the vertical tube being open but it may also be accomplished by holes or slits in the side of the vertical tube itself.

A preferable embodiment of the present invention is for the vertically extending tubular means to have a removeable and accessable top section so that chlorine in solid or liquid form may be added so as to purify any fluid discharged through the siphon tube. Such an embodiment can comprise a removable threaded top section such as a lid which threadedly engages thereon, so that the chlorine may be periodically placed in the tube.

Preferably the vertical tube is approximately 3 feet long from the uppermost point to its lowermost point with the siphon tube extending through the sidewall of the vertical tube approximately 6 inches below the uppermost point of the top section of the vertical tube. The connection of the siphon hose through the vertical tube may or may not be watertight depending upon individual preferences or manufacturing capabilities but the siphon tube must be fluid tight from one end to the other. The lowermost end of the inside part of the siphon tube is preferably approximately 4 inches above the lowermost point of the bottom of the vertical tube.

The vertical tubular section is preferably 4 inches in diameter and made from appropriate conventional materials now on the market for drain tiles and the like, such materials including but not limited to, plastics, rubber, fired clay, ceramics, metal and other materials that will not deterioriate in the environment of the leach bed in which it may be installed.

A further part of this invention comprises a septic tank soil absorption system that includes a watertight septic tank with an inlet and outlet line. The inlet line is for accepting fluidized waste materials and the outlet line is for percolation. The system of the invention comprises the vertically extending, self-activated siphon pump mounted in the leach bed area substantially as described in detail above in conjunction with the watertight septic tank.

Further included in the present invention is the method of treating fluid waste material that comprises flowing the waste material into a watertight tank for waste treatment and taking the treated fluid waste material and flowing it to a leach bed area. With the treated fluid waste in the leach bed area, excess fluid levels are then siphoned off automatically by a siphon hose that is actuated by a predetermined fluid level in the leach bed area. The processed fluid waste is further chlorinated as it passes down the siphon hose or before it is discharged from the leach bed area by the siphon hose.

Further, included in the present invention is the installation of a self-actuated pump in the lower floors of buildings such as basements of dwellings. A tube is installed so that it extends in a vertical direction from the floor and means for fluid surrounding the tube are provided so that it can seek its own level inside the tube. A siphon hose is provided having one end that communicates with the lower portion of the inside diameter of the tube. The siphon tube extends from said one end upwardly towards the upper portion of said tube and then outwardly from the tube to a disposal area. The outward end of the siphon hose terminates at a lower vertical point than said one end.

It is an object of the present invention to provide a design for automatic elimination of excess fluid in leach bed areas of septic water treatment systems. It is a further object of the present invention to provide for systematic removal of silt accumulation in leach bed areas of septic tank water treatment systems. It is a still further object of the present invention to kill bacteria and reduce odors from any excess fluids discharged from a septic tank fluid treatment system.

It is a still further object of the present invention to provide a system to handle and eliminate excessive water due to storms that may enter leach bed areas of septic tank sewage treatment systems.

It is a further object of the present invention to provide a self-activated drain pump for lower floors of buildings.

It is a still further object of the present invention to provide a self-activated drain pump for basements of dwellings.

It is an additional object of the present invention to provide a self-cleaning self-activated drain pump.

It is a still further object of the present invention to provide a back-up system to convention drain systems.

For a more complete understanding of the invention and the objects and advantages thereof, reference should be had to the accompanying drawings and the following detailed description wherein a preferred embodiment of the invention is illustrated and described.

DETAILED DESCRIPTION OF THE PREFERRED EMBODIMENTS

Figure 1:
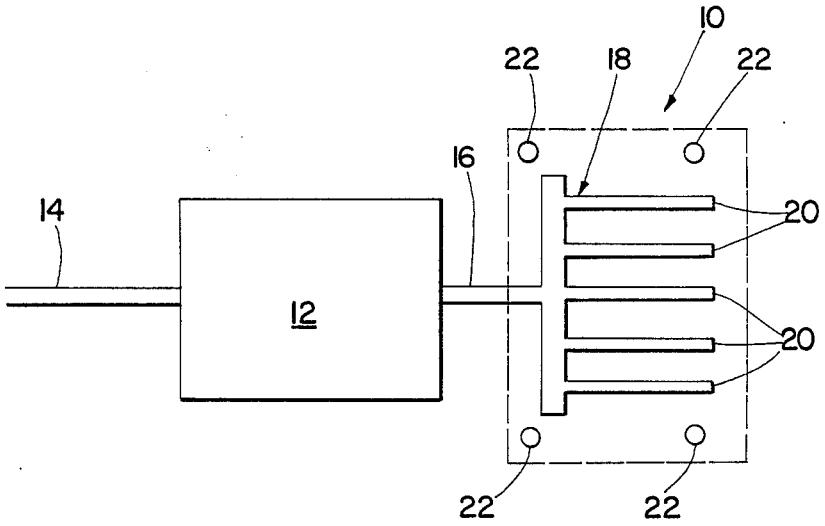
FIG. 1 is a plan view of a septic type sewage treatment facility according to the present invention.

What is shown in FIG. 1 is a septic tank water treatment system shown as 10 having a septic tank 12 with inlet line 14 and outlet line 16. The outlet line 16 leads to a distribution network 18 that has several distributing pipes 20 embedded in the ground area of the leach bed. The distribution pipes 20 are normally embedded in the ground a few feet or more feet beneath the surface and are covered by soil or any appropriate material that may be required by federal, state or local regulations. The soil material surrounding and underneath the distributing pipes may be made up of any type of soil that will allow the required percolation rate so that the fluids may drain out of the distribution system 18 through pipes 20 and return to the natural water table that is beneath the leach bed area. The waste fluid coming down pipe 14 is normally from a dwelling or living quarters and flows into the septic tank 12. The septic tank 12 is normally a watertight type of enclosure made of cement, metal, plastic or other appropriate material in which bacterial action is allowed to take place so as to reduce the waste fluid to sludges, gases, and effluent material. The effluent material then passes from the septic tank 12 through pipe 16 through to the distribution network 18 and out into the leach bed area through pipes 20. Shown in FIG. 1 are four fluid pumps 22 according to the present invention although only one pump 22 may be necessary in most leach beds, and are designed to handle any overflow fluid that may enter the system as a result of a storm or other uncontrollable floodings of the leach bed area.

Figure 2:
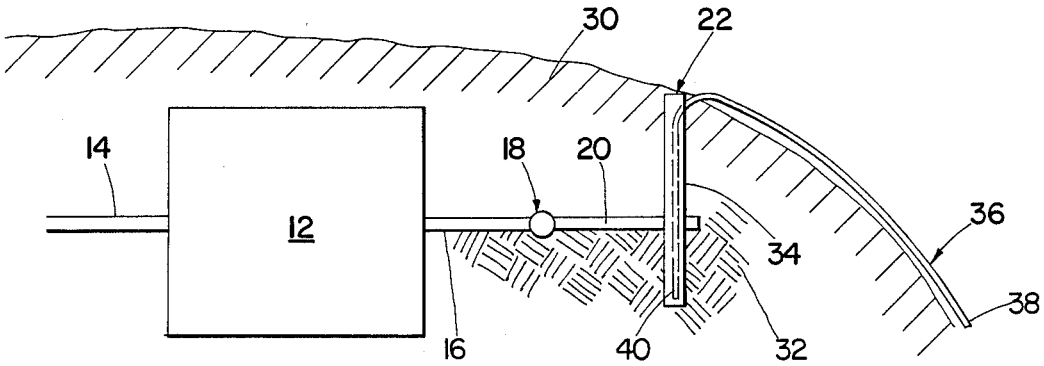
FIG. 2 is a sectional side view of a septic type sewage treatment facility according to the present invention.

Shown in FIG. 2 is again a septic tank 12 that is of a watertight type design with an inlet pipe 14 and an outlet pipe 16 which goes to a distribution system 18 that has pipes 20 extending outwardly through the leach bed area. Water sewage treatment system installation will be required to follow the federal, state and local requirements, of course, with such regulations including the type of fill material or ground cover 30 that appears above the distribution system 18 and further may define the type of soil as shown at 32 which may be crushed limestone or other material that allows the effluent material to percolate down through the soil to re-enter the water table of the surrounding area. Shown in FIG. 2 is a fluid pump 22 according to the present invention. The fluid pump 22 comprises a vertical tube 34 that in most cases may extend 1½ to 10 feet in a vertical direction depending upon the requirements and/or construction of the particular sewage treatment facility. In addition to the vertical tube 34, there is a siphon line 36 that extends outwardly from the vertical tube 34 and at some point connects through the ground cover to ground level and down a slope, so that the lowermost point 38 of siphon tube 36 is in a lower vertical plane than the other end of siphon tube 36 shown at 40. The other end 40 of the siphon tube 36 is shown extending inside vertical tube 34 to a lowermost point of tube 34. The pump according to the invention is designed to work when the fluid level in the leach bed, through which the distribution pipes 18 and 20 extend, reaches the top of the vertical tube 34 and communicates water pressure through the vertical tube to the lowermost end 40 of the siphon tube 36 which is inside the vertical tube 34. When this occurs the water or fluid will rise through the vertical portion of siphon tube 36 and flow outwardly from the vertical tube 34 and down to the lowermost point 38 of siphon tube 36. Once the water reaches a steady flow in the siphon tube 36 the flow will continue until the water level in the vertical tube 34 reaches the lower most inside end 40 of the siphon tube 36. The water flowing outwardly in the siphon tube 36 will carry with it silt or other fine particulate material that may have entered the system and could contribute to the inefficiency of the percolation rate of the leach bed.

Figure 3:
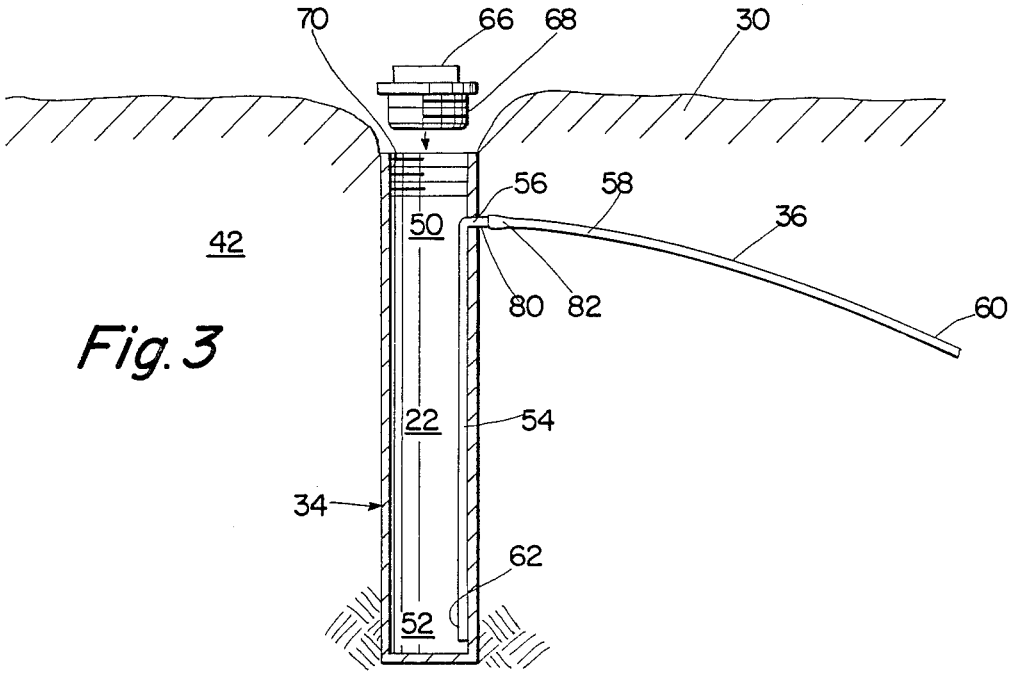
FIG. 3 is a sectional side view of the fluid drain pump according to the present invention.

What is shown in FIG. 3 is again a vertical tube 22 in a leach bed area 42 as shown. The vertical tube 22 has an upper end 50 and a lower end 52 with a separate tube portion 54 built into the side of the vertical tube 22. The tube portion 54 extends to the lower end 52 of the vertical tube 22 and preferably terminates approximately two to four inches above the lowermost point 52 of vertical tube 22. The upper portion of the tube portion 54 is shown at 56 and extends through the outside diameter wall of vertical tube 22 and connects to the outer and upper portion 58 of siphon tube 36. The outer portion 58 of siphon tube 36 then extends outwardly and downwardly from the vertical tube 22 so that the excess fluid may be discharged downhill from the leach bed as was previously explained. The outer end 60 of siphon tube 36 will have an end terminating at a lower vertical point than the lowermost vertical point shown in 62 of tube portion 54. Also shown in FIG. 3 is a removable cap 66 on vertical tube 22 that is preferably threaded as at 68 so as to mate or make a fluid tight connection with the upper portion of vertical tube 22. Cap 66 may form a watertight or fluid tight connection by being threaded onto cooperating threads 70 from vertical tube 22. Cap 66 may then be removed so that chlorine may be added to the vertical tube 22 and then cap 66 replaced. In this way any effluent or excess fluids that are dishcarged through siphon tube 36 may be almost bacteria free and practically odorless when it exits from lower end 60 of siphon tube 36. The advantage of the chlorine being placed in the upper portion 50 of the vertical tube 22 under cap 66 is that it will not be effected by any sunlight and will last longer because of the cooler temperatures in the tube 22.

Shown in FIG. 3 is also the ground cover 30 as described in FIG. 1. Also shown in FIG. 3 the height of vertical tube 22 is normally and preferably approximately 3 feet and its diameter is preferably 4 inches, with the upper end 56 of the tube portion 34 being located about 6 inches below the uppermost point of portion 50 of vertical tube 22. The overall length of the vertical tube 22 in FIG. 3 is then approximately 3 feet and the siphon tube is preferably a ¾ inch plastic pipe with a slip-on/slip-off connection at point 80 and 82. The slip-on/slip-off connection shown at 80, 82 is so that the siphon tube 36 may be connected to the permanently formed tube portion 54 in a water or fluid tight fashion.

Figure 4:
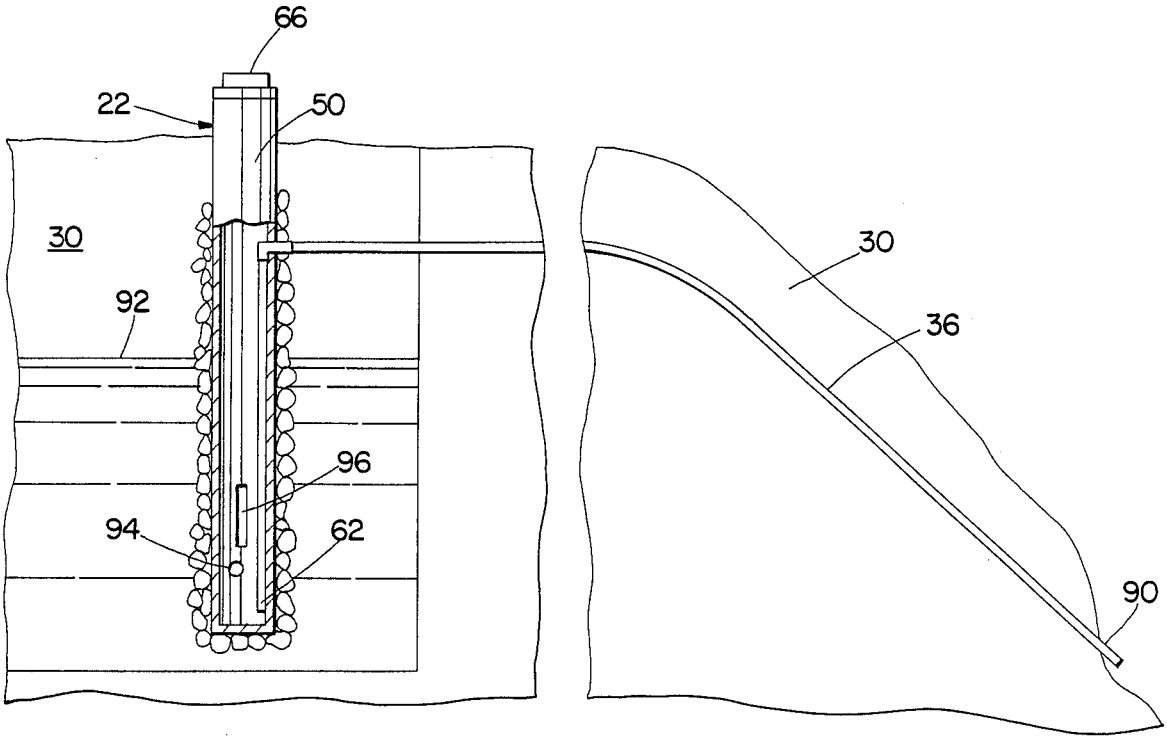
FIG. 4 is a further sectional side view of the fluid drain pump according to the present invention.

Shown in FIG. 4 is again the vertical tube 22 having a cap 66 threadedly fastened to the top portion 50 of the vertical tube 22 and the siphon tube 36 is shown extending outwardly from the vertical tube 22 and then extending under the ground cover 30 and downwardly in a vertical direction to a discharge point 90 which is lower in the vertical direction, than the lowermost point 62 of the inside portion of siphon hose 36. By locating the siphon hose under the ground cover as it extends downwardly, any possibility of freezing may be eliminated during the winter months. Shown in FIG. 4 is also more ground cover 30 and a fluid level 92 shown surrounding the vertical tube 22. It is important that the fluid level 92 have a means to communicate with the inside diameter of the vertical tube 22 and seek its own level and such means for doing so are shown as at 94 and 96 in the lower part of vertical tube 22. Means 94 as shown represents a perforation in the vertical wall of tube 22 and means 96 is shown indicating a slit in the vertical wall of tube 22. Means for communicating may also be provided by tube 22 being open ended at its bottom. When the fluid level 92 can communicate to the inside diameter or vertical tube 22 it may also communicate with lower part 62 of the siphon tube 36 so that the water flowing into the vertical tube will be forced outside siphon tube 36 when the fluid level 92 reaches a level near the upper portion 50 of the tube 22. Once the fluid level reaches the upper level 50 of tube 22 the water will begin to flow through the lower end 62 of siphon hose 36 and outwardly and downwardly to the lowest point 90 where the fluid then will be discharged into a ground area to evaporate or flow on and down into a disposal area. It is important therefore that the water being discharged through port 90 be reduced in bacteria and odor as much as possible.

Figure 5:
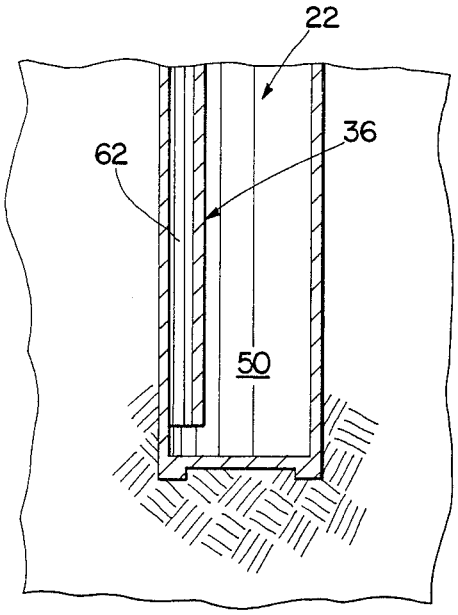
FIG. 5 is a detailed sectional view of one embodiment of the fluid drain pump according to the present invention.

Shown in FIG. 5 is another construction of the vertical tube 22 shown at the lower end 50 thereof and having the inside end 62 formed as an integral part of the siphon hose 36.

Figure 6:
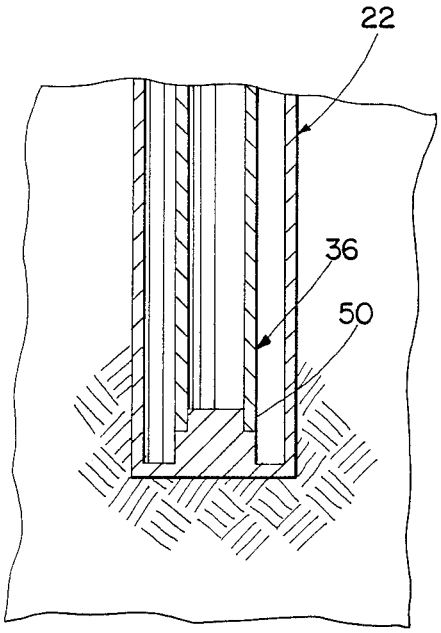
FIG. 6 is another sectional side view of a further embodiment of the fluid drain pump according to the present invention.

FIG. 6 shows an alternate embodiment of the tube 22 having a concentric lower end 50 of the siphon tube 36 inside of the vertical walls of tube 22. Either one of these constructions may be used depending upon the manufacturers choice due to ease of manufacture.

Figure 7:
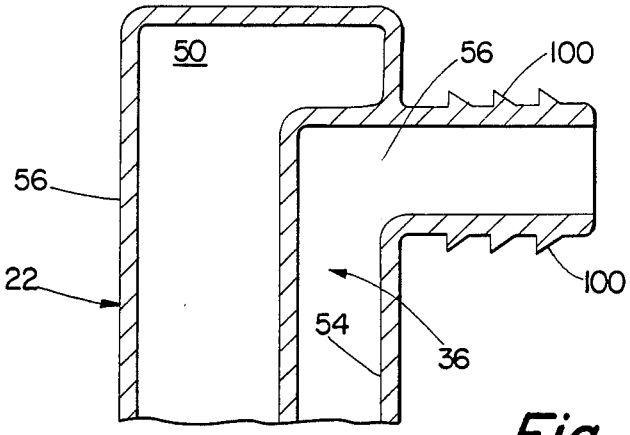
FIG. 7 is a sectional side view of a still further embodiment of the fluid drain pump according to the present invention.

Shown in FIG. 7 is again the top end 50 of the vertical tube 22 and having the upper end 56 of tube portion 54 formed as an intragal part of vertical tube 22 and having threaded a raised ridge 100 so that a plastic tube or other appropriate material may be slipped over portion 100 and form a water or fluid tight connection in order to operate the siphon tube 36.

Figure 8:
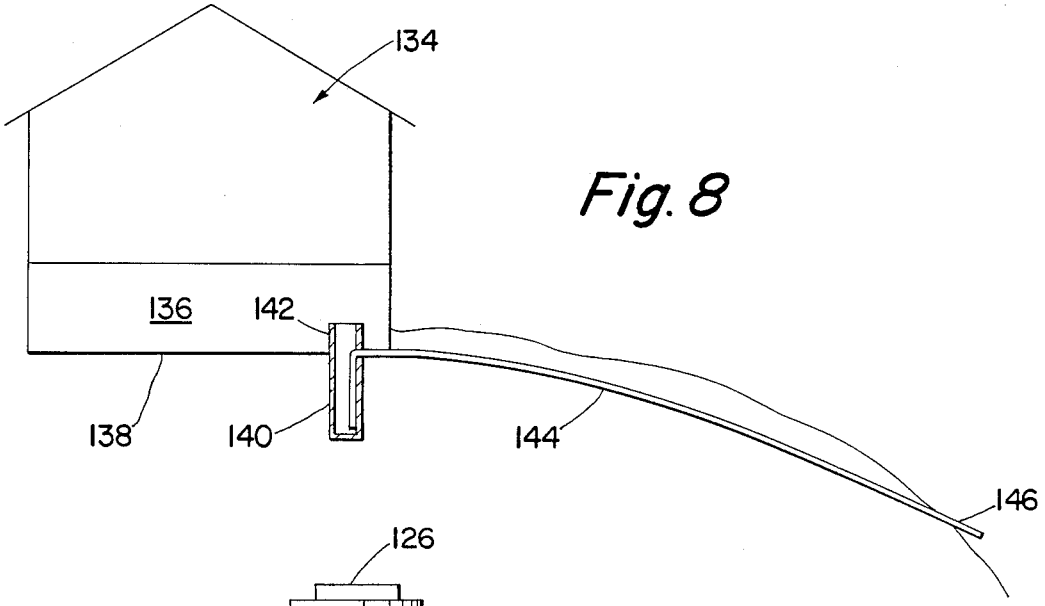
FIG. 8 is a sectional side view of an embodiment of a self-actuated fluid drain pump according to the present invention.

What is shown in FIG. 8 is a self-actuated storm of fluid drain pump according to the present invention. The pump has a vertically extending tube means 120, with a collar 122, which slips over the upper end of the tubular means 120 in a fluid tight fashion; the fitting may be glued or otherwise permanently fixed into position. The collar 122 is threaded as is shown in 124 so that it may accept a cap 126 which is also threaded so that it may removably engage the threaded section 124 of collar 122. The siphon tube used in the embodiment picture has a plastic hose 128 which extends from the lower portion of tube means 120 upwardly to an upper section of tube means 120. There it joins an elbow fitting shown at 130, with preferably a 90° elbow, at the lowermost section of the elbow and forms a fluid tight connection to the upper end of hose 128. The elbow 130 extends through a perforation in the upper wall section of tube means 120 just below the collar 122. The elbow 130 has one end extending through the wall of tube means 120 and outwardly therefrom so that it may connect with hose 132 in a watertight fashion and complete the siphon tube means as was earlier described. The siphon tube of the present invention will be comprised of hose 128 elbows 130 and hose 132 with the end of hose 132 terminating in the section that is lowermost vertically than the lowermost point of hose 128.

Figure 9:
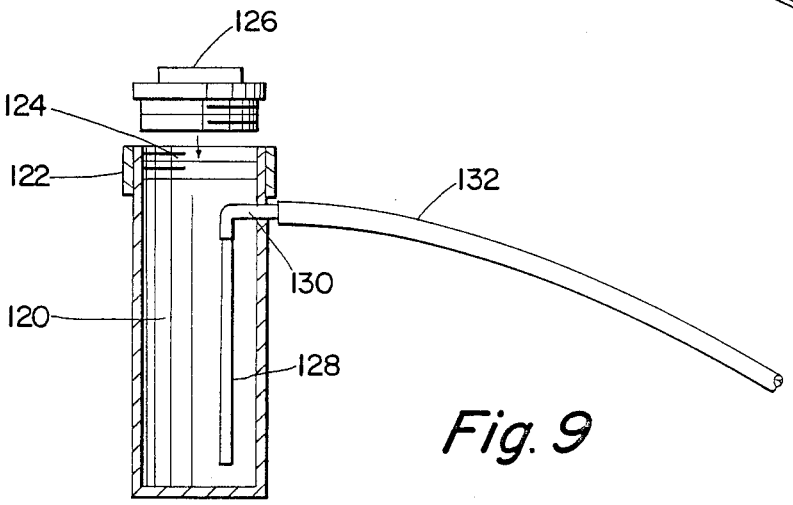
FIG. 9 is a sectional side view of a fluid drain pump according to the present invention for use in conjunction with basements or lowermost floors of buildings or dwellings.

Shown in FIG. 8 is a dwelling house or building 134 having a basement or lower floor 136. The basement 136 has a base floor 138 that is usually furnished with some sort of drain system. Shown in FIG. 9 is the base floor 138 having installed a self-actuated storm pump according to the present invention and shown as 140. The self-actuated storm pump according to the present invention extends in a vertical direction from the base floor 138. The vertical direction may either be upwardly or downwardly or it may extend in both directions depending upon the ease of installation. The vertical tube 142 of the pump 140 shown in the corner in FIG. 9 extends downwardly through the basement of 138 and also has an upwardly extending section above the base floor of 138. The siphon hose 144 is again shown extending from the bottom of the vertical tube 142 upwardly so that it passes through an outside diameter wall of tube means 142 and extends outwardly from the envelope of the building 134 and has an end 146 that terminates outside of the building in a disposal area. Note again the tube 144 has end 146 terminated and a lower vertical point than the lowermost end of the siphon tube located within the vertical tube means 142. In this manner any excess fluid level that accumulates on the base floor 138 will fill the vertical tube means 142. Means on the vertical tube means 142 are provided so that the water surrounding the upwardly extending part of the vertical tube has allowed to communicate and seek its own level inside the vertical 142. When the fluid level on the base floor 138 and the fluid level in the vertical tube 142 rise above the highest point of the siphon tube 146 a sufficient amount, water will then be forced up through the end of the siphon tube 144 and outwardly to the terminal end 146 of siphon tube 144. This action will then continue until the water level inside the vertical tube means is just below the end of siphon tube 144 and the tube means 142. In this manner all of the water on the base floor 138 will be siphoned out to the disposal area. Thus, automatically pumping out any excess fluid or flood waters that may have accumulated on the base floor 138.

As can be seen from the above description the self-actuated storm pump of the present invention has many advantages over other type pump systems that may be used to drain leach beds or basements. The pump of the present invention has no valves to open or close, it has no outside power driven conventional mechanical pumps to create a flow and no switches that need turned on or off. There are no special filters that need to be installed to prevent any conventional pump means from clogging. The pump of the present invention is self-regulating in that the fluid level in the vertical tube 22 and hence the leach bed or basement determines when the storm pump will begin to discharge and when it will stop discharging fluid. The storm pump of the present invention disposes of water from a higher level to a lower level and the surging action created thereby prevents any silt build-up in the leach bed system and periodically performs a self-cleaning of the leach bed in its system. The storm pump according to the present invention is unique that there are no moving parts to wear out and the construction or design of the pump can be singular in nature although the construction can be of 1, 2 or more pieces connected together to form a substantially one piece construction. Utilizing a system such as described, has been found possible to drain a 1200 square foot leaching bed in approximately two hours. This is also more effective than replacing a leach bed which is very expensive.

It will thus be seen that the object set forth above, among those made apparent from the preceeding description, are efficiently attained and since certain changes may be made in the above construction without departing from the scope of the invention, it is intended that all matter contained in the above description or shown in the accompanying drawings shall be interpreted as illustrative and not in a limiting sense.

While a preferred embodiments of the invention has been illustrated and described herein, it will be understood that changes and additions may be made therein and thereto without departing from the spirit of the invention. Reference should, accordingly, be had to the appended claims in determining the scope of the invention.

I claim:

1. An overflow activated drain pump comprising:

a. vertically extending tubular means having a top and bottom section;

b. means for allowing fluid surrounding the outside of said tubular means to seek its own level inside said tubular means; and c. a siphon tube having one end inside said vertically extending tubular means, said one end extending toward the bottom section of said tubular means and terminating in a lowermost end, and the other end extending outwardly of said vertically extending tubular means from a position above said lowermost end to a disposal area, so that when said pump is installed, said other end has a terminal point that is positioned lower in a vertical direction than said lowermost end of said one end, said one end of said siphon tube having communication with the inside of said tubular means so that when the water level inside said tubular means rises above the siphon tube, the water in the tube is drained until the water level in said tubular means is the same as the lowermost end of said one end of said siphon tube.

2. An overflow actuated rain pump according to claim 1 which further comprises means for chlorinating the fluids discharged through said siphon tube.

3. An overflow actuated drain pump according to claim 1 in which the siphon tube extends through the outer top section wall of said vertically extending tubular means and said one end is located within said tube means.

4. An overflow actuated drain pump according to claim 3 in which said vertical extending tubular means is a substantially four inch diameter tube extending substantially three feet in overall vertical dimension and in which said siphon tube extends through the outer top section wall substantially six inches below the uppermost vertical point on said vertically extending tube.

5. An overflow actuated drain pump according to claim 1 or 4 in which said one end extends to substantially four inches above the lowermost point on said bottom section of said vertically extending tubular section.

6. An overflow actuated drain pump according to claim 1 or 4 in which said tubular means is comprised of plastic material.

7. An overflow actuated drain pump according to claim 1 or 4 in which said siphon tube has a fluid tight connection through said top section of said vertically extending tubular means.

8. An overflow actuated drain pump according to claim 1 in which said tubular means comprises an elongated tube having a threaded collar on one end and a removeable cap threadingly engaged with said collar.

9. An overflow actuated drain pump according to claim 8 in which said siphon tube comprises two pieces of hose and elbow fittings, the first of two pieces of hose located inside said tubular means and extending upwardly to connect to said elbow fitting, said elbow fitting located in a perforation formed in an upper wall of said tubular means just below said threaded collar, and the secured pieces of hose connections to said elbow extending outwardly and downwardly from said tubular means to complete said siphon tube.

10. A septic tank soil absorption system which comprises:

a. a watertight septic tank having an inlet line and outlet line with the inlet line for admitting waste fluid material and the outlet line for discharging processed fluid material;

b. a leach bed for accepting processed fluid materials from a septic tank and having a ground cover and a percolation bed;

c. a vertically extending tube in said leach bed area with means to allow fluid outside said tube to seek its own level inside said tube;

d. a siphon hose extending through the wall of said vertically extending tube, said siphon tube having one end extending toward the bottom of said vertical tube inside said tube and another end extending outwardly and downwardly from the outside of said vertical tube with its outside end extending to a lowermost vertical point than its inside end so that fluid collection above the point where the siphon hose extends through the wall of the vertical extending tube tends to start fluid flowing up inside end of the siphon tube and down the outside end of the siphon tube to a disposal area.

11. A septic tank soil absorption system which comprises:

a. a watertight septic tank having an inlet and outlet line with the inlet line for admitting waste fluid material and the outlet line for discharging processed fluid material;

b. a leach bed for accepting processed fluid materials from a septic tank and having a ground cover and a percolation bed;

c. a vertically extending tube in said leach bed area with means to allow fluid outside said tube to seek its own level inside said tube; and d. a siphon hose extending over a portion of the outside diameter wall of said vertically extending tube, said siphon tube having one end extending toward the bottom of said vertical tube inside said tube and another end extending outwardly and downwardly from the outside of said vertical tube with its outside end extending to a lowermost vertical point than its inside end so that fluid collection above the point where the siphon hose extends through the wall of the vertical extending tube tends to start fluid flowing up the inside end of the siphon tube and down the outside end of the siphon tube.

* * * * *